US008120572B2

(12) United States Patent
Chu et al.

(10) Patent No.: US 8,120,572 B2
(45) Date of Patent: Feb. 21, 2012

(54) LIQUID CRYSTAL DISPLAY PANEL

(75) Inventors: Cheng-Jen Chu, Tainan County (TW); Li-Nien Lin, Tainan County (TW); Chia-Liang Lin, Tainan County (TW)

(73) Assignee: Chimei Innolux Corporation, Miao-Li County (TW)

( * ) Notice: Subject to any disclaimer, the term of this patent is extended or adjusted under 35 U.S.C. 154(b) by 930 days.

(21) Appl. No.: 12/124,213

(22) Filed: May 21, 2008

(65) Prior Publication Data

US 2008/0291186 A1 Nov. 27, 2008

(30) Foreign Application Priority Data

May 22, 2007 (TW) ..... 96118187 A

(51) Int. Cl.
*G09G 3/36* (2006.01)

(52) U.S. Cl. ..... 345/103; 345/92

(58) Field of Classification Search ..... 345/87–100, 345/205, 206; 349/110, 114
See application file for complete search history.

(56) References Cited

U.S. PATENT DOCUMENTS 4,922,240 A * 5/1990 Duwaer ..... 345/100
5,151,689 A * 9/1992 Kabuto et al. ..... 345/103
7,907,131 B2 * 3/2011 Su et al. ..... 345/204

* cited by examiner

*Primary Examiner* — Kevin M Nguyen
*Assistant Examiner* — Sepideh Ghafari
(74) *Attorney, Agent, or Firm* — Lowe Hauptman Ham & Berner LLP

(57) ABSTRACT

In a liquid crystal display panel, each pixel unit includes first and second pixels, a first scan line coupled to the first pixel, and a second scan line coupled to the second pixel via an active element. During a first scan period, the first scan line, the second scan line and the active element are all activated to write a first voltage to the first and second pixels. During a second scan period, the first scan line remains activated but the second scan line and the active element are deactivated so that a second voltage is written to the first sub-pixel and the second sub-pixel is maintained at the first voltage.

20 Claims, 9 Drawing Sheets

LIQUID CRYSTAL DISPLAY PANEL

This application claims the benefit of Taiwan application Serial No. 96118187, filed May 22, 2007, the entirety of which is incorporated herein by reference.

BACKGROUND

1. Technical Field

The disclosure relates to a liquid crystal display (LCD).

2. Description of Related Art

In general, thin film transistor (TFT) LCDs, for mobile phones, language translators, digital cameras, digital camcorders, personal digital assistants (PDAs), notebook computers, and desktop displays, can be categorized into transmissive TFT-LCDs, reflective TFT-LCDs, and transflective TFT-LCDs based on the way in which light sources are utilized and on the differences of array substrates. The transmissive TFT-LCD mainly adopts backlight as the light source. Pixel electrodes on a TFT array substrate of the transmissive TFT-LCD are transparent electrodes, so as to facilitate the penetration of light from the backlight source.

The reflective TFT-LCD mainly employs front-light or external light as the light source. The pixel electrodes on the TFT array substrate are metal electrodes or other reflective electrodes with good reflectivity suitable for reflecting the light from the front-light source or the external light source. On the other hand, the transflective TFT-LCD can be regarded as a structure that integrates both the transmissive TFT-LCD and the reflective TFT-LCD, and both the backlight source and the front-light source or the external light source can be utilized by the transflective TFT-LCD simultaneously to display images.

FIG. 1A is a partial cross-sectional view of a conventional transflective TFT-LCD panel. In a transflective TFT-LCD panel 100*a* having a single cell gap, a transparent pixel electrode 120*a* disposed in a transmissive region 104*a* and a metal pixel electrode 110*a* disposed in a reflective region 102*a* have identical heights.

Generally, in the transflective TFT-LCD panel 100*a*, the metal pixel electrode 110*a* in the reflective region 102*a* reflects the front-light source or the external light source, while the transparent pixel electrode 120*a* in the transmissive region 104*a* allows the light projected by a backlight module (not shown) to penetrate the transparent pixel electrode 120*a*.

In detail, after the light from the front-light source or the external light source enters the TFT-LCD panel 100*a*, the light incident on the reflective region 102*a* is reflected by the metal pixel electrode 110*a* and then returns to the outside world from the TFT-LCD panel 100*a*. Moreover, the light provided by the backlight module penetrates the transparent pixel electrode 120*a* and the transmissive region 104*a*, and then passes through the TFT-LCD panel 100*a* to the outside world.

It should be noted that a distance that light beams travel through the reflective region 102*a* of a liquid crystal layer is approximately twice the distance that light beams travel through the transmissive region 104*a* of the liquid crystal layer. Therefore, the light beams transmitted through the reflective region 102*a* of the liquid crystal layer and those transmitted through the transmissive region 104*a* have different phase retardations. Under the circumstances, the transflective TFT LCD panel 100*a* has unfavorable display performance. When same voltages are respectively applied to liquid crystal molecules in the transmissive region 104*a* and in the reflective region 102*a*, the light beams should have a phase retardation of half the wavelength after passing through the transmissive region 104*a*, and should have a phase retardation of one quarter of the wavelength of light after passing through the reflective region 102*a*, so as to optimize opto-electrical properties.

FIG. 1B is a partial cross-sectional view of another conventional transflective TFT-LCD panel. As indicated in FIG. 1B, to resolve the above described issue, a method of fabricating a transflective TFT-LCD panel 100*b* having a dual cell gap has been developed.

Like TFT-LCD panel 100*a*, after the light from the front-light source or the external light source enters the TFT-LCD panel 100*b*, the light incident on a reflective region 102*b* is reflected by a metal pixel electrode 110*b* and then returns to the outside world from the TFT-LCD panel 100*b*. Moreover, the light provided by the backlight module penetrates a transparent pixel electrode 120*b* and a transmissive region 104*b*, and then passes through the TFT-LCD panel 100*b* to the outside world.

In the transflective TFT-LCD panel 100*b* having the dual cell gap, the cell gap of the transmissive region 104*b* is twice the cell gap of the reflective region 102*b*. Thus, in the reflective region 102*b*, a light path of the light entering from the front of the transflective TFT-LCD panel 100*b* is then equal to the light path of the light provided by the backlight module in the transmissive region 104*b*, so as to preclude the lights from having different light paths in the reflective region 102*b* and the transmissive region 104*b*. Therefore, the different opto-electrical performance in the two regions is avoided.

However, the dual cell gap raises complexity and difficulty in fabricating the TFT-LCD panel 100*b*. In light of the foregoing, manufacturing the transflective LCD penal having the single cell gap becomes an issue to be solved.

SUMMARY OF THE INVENTION

Embodiments of the present invention are directed to one or more of a transflective LCD penal having an active array substrate with a single cell gap, a transflective LCD panel having a single cell gap, and an LCD having a transflective LCD panel with a single cell gap.

The present invention in some embodiments provides a pixel unit for a liquid crystal display (LCD) panel that has a display region and a non-display region. The pixel unit comprises first and second pixels disposed in the display region; an active element disposed in the non-display region and coupled to the second pixel; a pair of scan lines, including a first scan line coupled to the first pixel and a second scan line coupled to the active element; a data line; and controlling circuitry configured for placing (i) a first scan signal on the first scan line to drive the first pixel to a first pixel voltage from the data line during a first scan period, (ii) a third scan signal on the first scan line to drive the first pixel to a second pixel voltage from the data line during a second scan period, and (iii) a second scan signal on the second scan line to, collectively with the first scan signal on the first scan line, drive the second pixel to the first pixel voltage from the data line via the active element during the first scan period.

The present invention in further embodiments provides a liquid crystal display (LCD) panel having a display region and a non-display region surrounding the display region. The panel comprises N scan lines and M data lines disposed in the display region and extending into the non-display region, wherein the scan lines and the data lines are arranged to cross each other to define a plurality of pixel units, and N and M are non-zero positive integers; N sub-scan lines disposed on the substrate, wherein the scan lines and the sub-scan lines are arranged alternately. Each pixel unit is disposed in the display region and comprises: a first active device having a first gate electrode, a first drain electrode and a first source electrode, wherein the first gate electrode is connected to the $n^{th}$ scan line, and the first source electrode is connected to the $m^{th}$ data line, n being a positive integer from 1 to N, m being a positive integer from 1 to M; a first pixel electrode electrically connected to the first drain electrode; a second active device having a second gate electrode, a second drain electrode and a second source electrode, wherein the second gate electrode is connected to the $n^{th}$ sub-scan line, and the second source electrode is connected to the $m^{th}$ data line; a second pixel electrode electrically connected to the second drain electrode. A plurality of third active devices are disposed in the non-display region, each of the third active devices being disposed between the $n^{th}$ scan line and the $(n+1)^{th}$ scan line and having a third gate electrode, a third drain electrode and a third source electrode, wherein the third source electrode is connected to the $n^{th}$ sub-scan line, the third drain electrode is connected to the $n^{th}$ scan line, and the third gate electrode is connected to the $(n+1)^{th}$ scan line.

The present invention in yet further embodiments provides a method of driving a liquid crystal display panel. The panel comprises: a plurality of pixels disposed on the display region; a plurality of transistors disposed on the non-display region; a plurality of scan lines and data lines intersecting one another to define the pixels, wherein each said pixel is defined by a pair of adjacent said scan lines and one of said data lines and includes a first sub-pixel controlled by a first one in the pair of the scan lines, and a second sub-pixel controlled by a second one in the pair of the scan lines, said second scan line being coupled to one of the transistors. The method comprises: activating the first scan line, the second scan line and the respective transistor during a first scan period to write a first voltage from the respective data line to the first and second sub-pixels; and maintaining the first scan line activated and deactivating the second scan line and the respective transistor during a second, subsequent scan period to write a second, different voltage from the respective data line to the first sub-pixel and to maintain the second sub-pixel at the first voltage It is to be understood that both the foregoing general description and the following detailed description are exemplary only. Additional aspects and advantages of the disclosed embodiments are set forth in part in the description which follows, and in part are apparent from the description, or may be learned by practice of the disclosed embodiments. The aspects and advantages of the disclosed embodiments may also be realized and attained by means of the instrumentalities and combinations particularly pointed out in the appended claims.

BRIEF DESCRIPTION OF THE DRAWINGS

The accompanying drawings are included to provide a further understanding of embodiments of the invention, and are incorporated in and constitute a part of this specification.

DESCRIPTION OF EMBODIMENTS

Figure 1A:
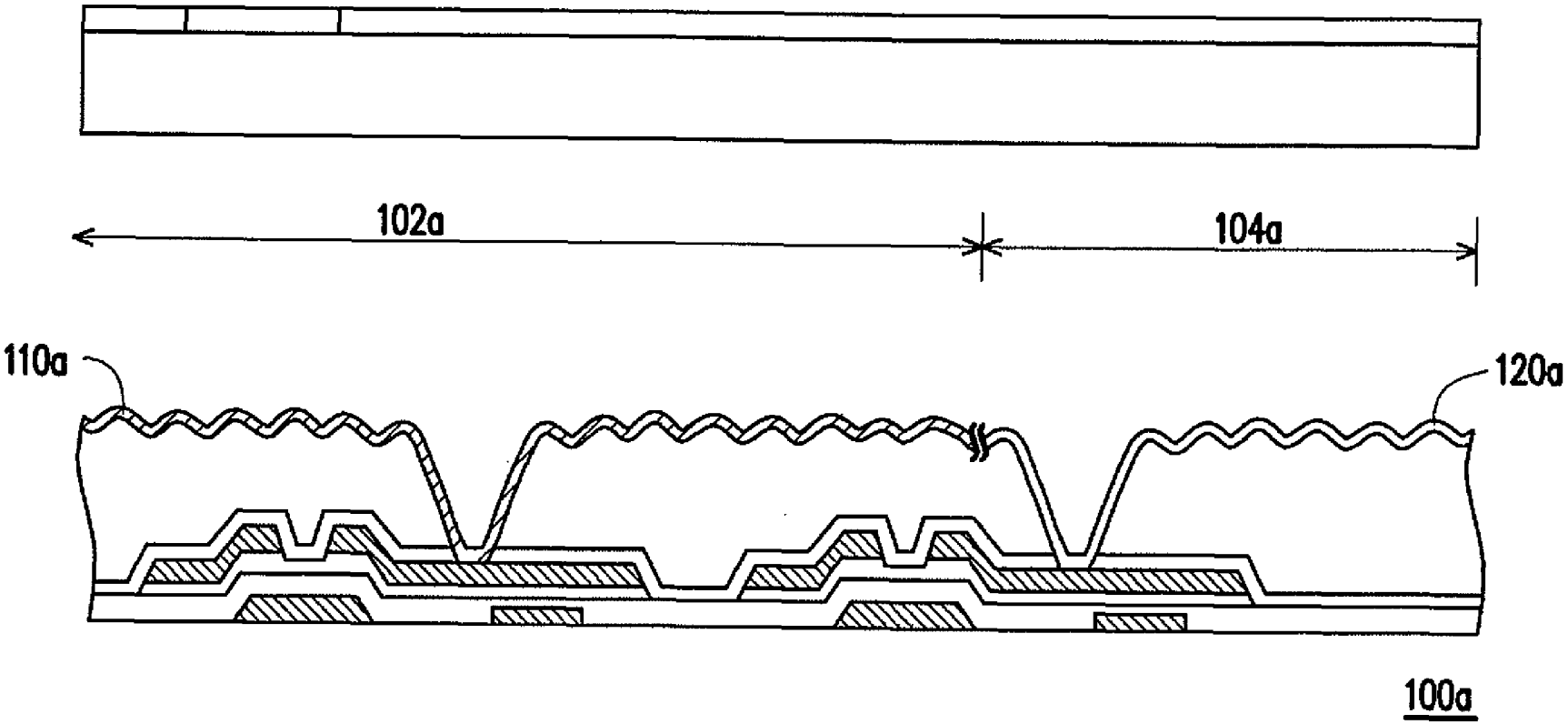
FIG. 1A(PRIOR ART)
FIG. 1A is a partial cross-sectional view of a conventional transflective TFT-LCD panel.
Figure 1B:
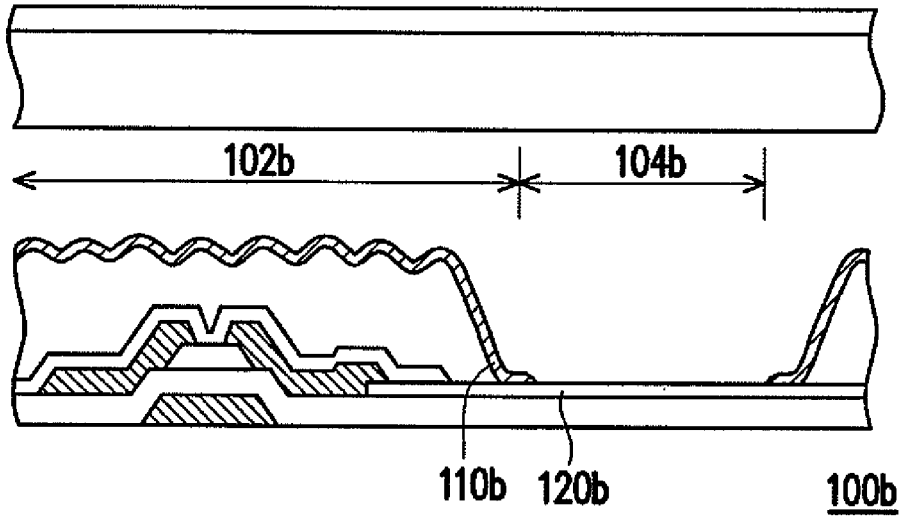
FIG. 1B(PRIOR ART)
FIG. 1B is a partial cross-sectional view of another conventional transflective TFT-LCD panel.

Reference will now be made in detail to embodiments of the invention, examples of which are illustrated in the accompanying drawings. Wherever possible, the same reference numbers are used in the drawings and the description to refer to the same or like parts.

Figure 2:
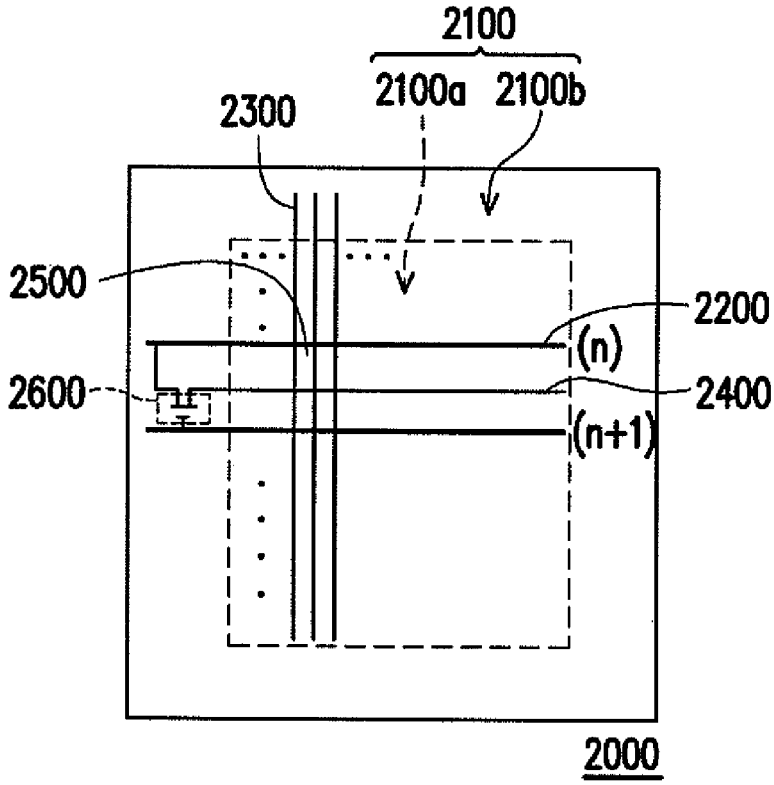
FIG. 2 is a schematic view of an active device array substrate according to an embodiment of the present invention.

FIG. 2 is a schematic view of an active device array substrate according to an embodiment of the present invention. Referring to FIG. 2, an active device array substrate 2000 of the present embodiment includes a substrate 2100, N scan lines 2200, M data lines 2300, N sub-scan lines 2400, a plurality of pixel units 2500, and a plurality of third active devices 2600, wherein N and M are positive integers larger than 1.

The substrate 2100 has a display region 2100*a* and a non-display region 2100*b* surrounding the display region 2100*a*. The scan lines 2200 and the data lines 2300 are disposed in the display region 2100*a* and extended to the non-display region 2100*b*. Here, the scan lines 2200 and the data lines 2300 are perpendicular to one another on the substrate 2100. In addition, the sub-scan lines 2400 are disposed on the substrate 2100, and the scan lines 2200 and the sub-scan lines 2400 are arranged alternatively and in parallel.

Figure 3A:
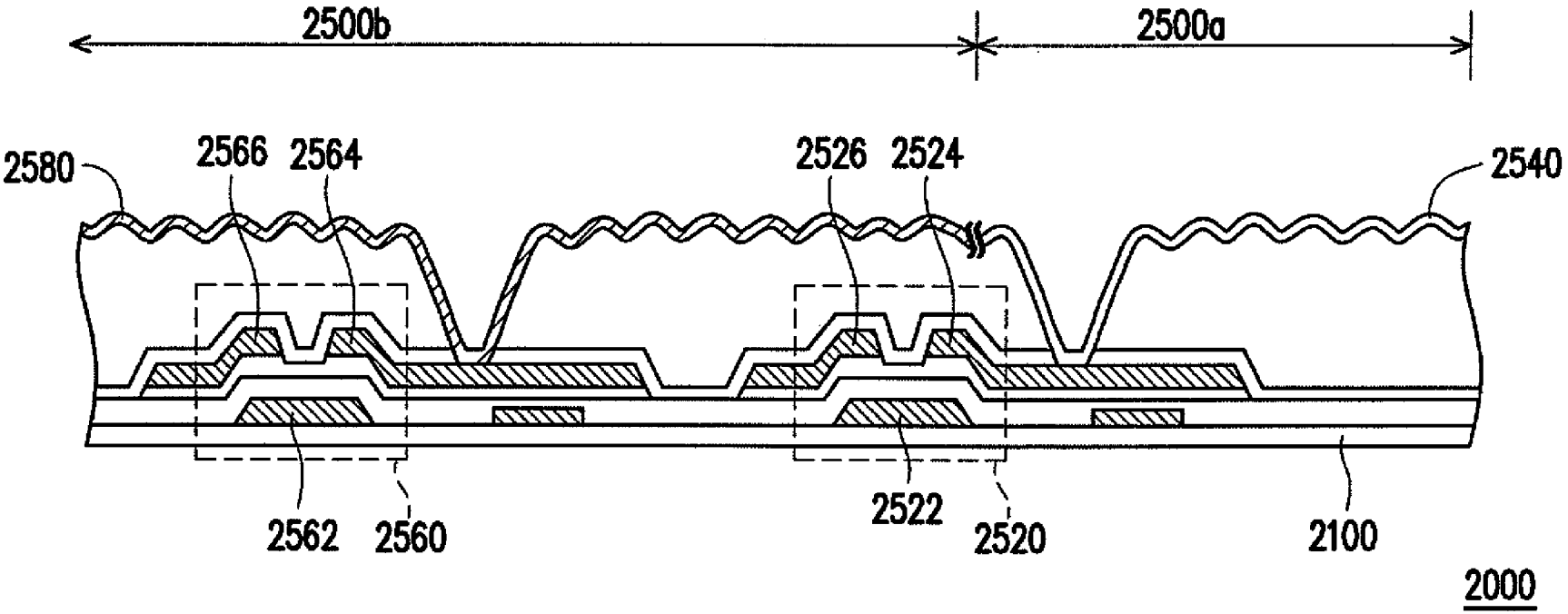
FIG. 3A is a schematic cross-sectional view illustrating a part of the active device array substrate depicted in FIG. 2.
Figure 3B:
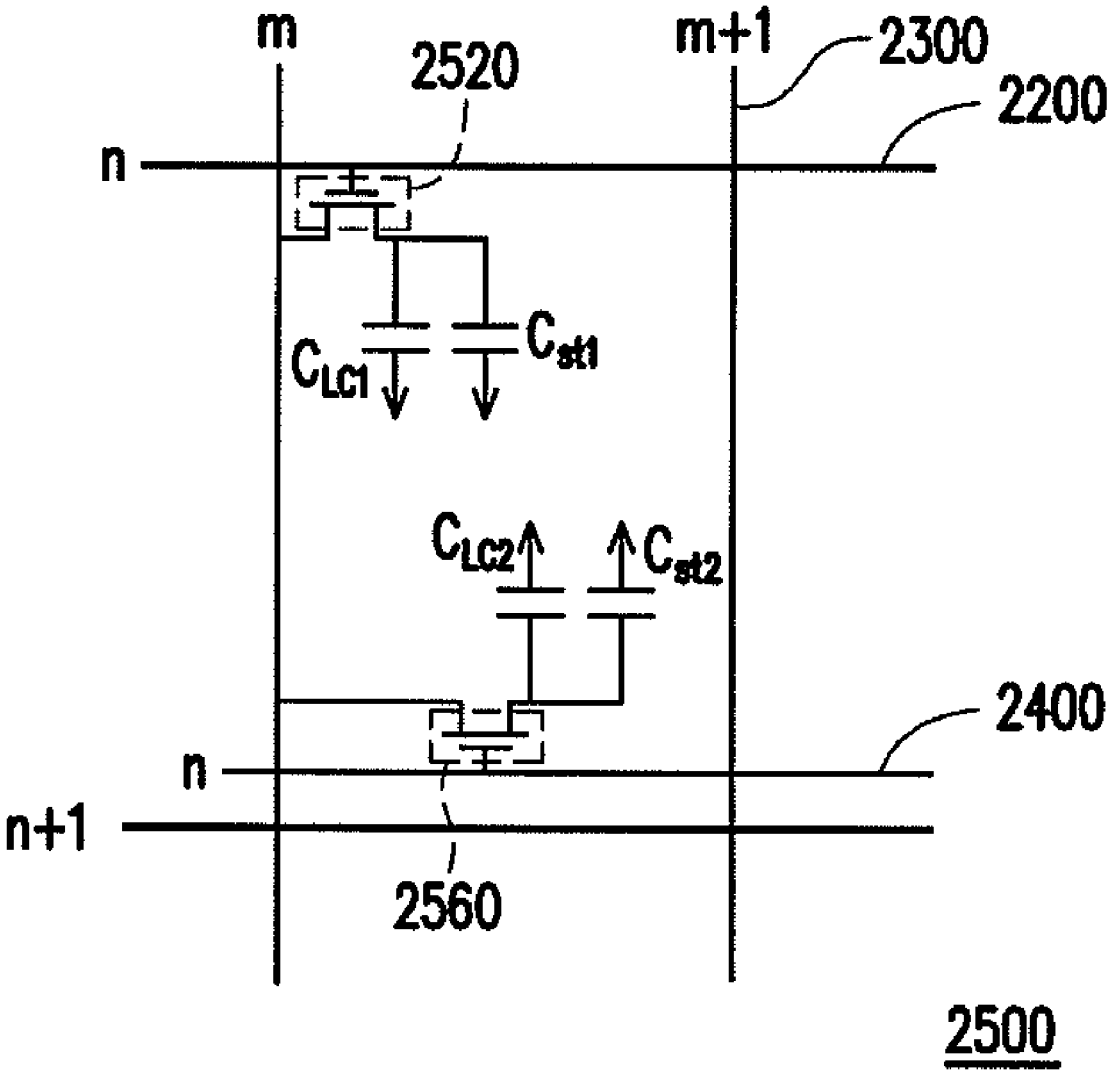
FIG. 3B is a circuit diagram of a single pixel unit on the active device array substrate depicted in FIG. 3A.

FIG. 3A is a schematic cross-sectional view illustrating a part of the active device array substrate depicted in FIG. 2, and FIG. 3B is a circuit diagram of a single pixel unit on the active device array substrate depicted in FIG. 3A. Referring to FIGS. 2, 3A and 3B, the pixel units 2500 are disposed in the display region 2100*a*, and each of the pixel units 2500 includes a first pixel region and a second pixel region. In the present embodiment, the first pixel region is, for example, a transmissive region 2500*a*, and the second pixel region is, for example, a reflective region 2500*b*. Besides, each of the pixel units 2500 includes a first active device 2520, a first pixel electrode 2540, a second active device 2560 and a second pixel electrode 2580.

To improve an aperture of the transmissive region 2500*a*, the first active device 2520 may be disposed within the reflective region 2500*b*. Moreover, the first pixel electrode 2540 is disposed in the transmissive region 2500*a* and is electrically connected to the first active device 2520. Here, a material of the first pixel electrode 2540 is a transparent material, such as ITO. Each first active device 2520 has a first gate electrode 2522, a first drain electrode 2524 and a first source electrode 2526. Referring to FIGS. 3A and 3B, the first gate electrode 2522 is connected to the $n^{th}$ scan line 2200, the first source electrode 2526 is connected to the $m^{th}$ data line 2300, and the first drain electrode 2524 is electrically connected to the first pixel electrode 2540, wherein n is a positive integer from 1 to N, and m is a positive integer from 1 to M.

The second active device 2560 and the second pixel electrode 2580 can be disposed in the reflective region 2500*b*, and the second pixel electrode 2580 is arranged in parallel to the first pixel electrode 2540 and is electrically connected to the second active device 2560. Here, a material of the second pixel electrode 2580 is a material with high reflectivity, such as metal. In detail, each second active device 2520 has a second gate electrode 2562, a second drain electrode 2564 and a second source electrode 2566. The second gate electrode 2562 is connected to the $n^{th}$ sub-scan line 2400, the second source electrode 2566 is connected to the $m^{th}$ data line 2300, and the second drain 2564 is electrically connected to the second pixel electrode 2580.

Referring to FIG. 2 again, the third active devices 2600 are disposed in the non-display region 2100*b*, and each of the third active devices is disposed between the $n^{th}$ scan line 2200 and the $(n+1)^{th}$ scan line 2200. Each third active device 2600 has a third gate electrode 2620, a third drain electrode 2640 and a third source electrode 2660. The third source electrode 2660 is connected to the $n^{th}$ sub-scan line 2400, the third drain electrode 2640 is connected to the $n^{th}$ scan line 2200, and the third gate electrode 2620 is connected to the $(n+1)^{th}$ scan line 2200.

The scan lines 2200 and data lines 2300 are connected to receive driving and data signals from respective driving circuits (not shown). The sub-scan lines 2400, in this particular embodiment, are not connected to any specific driving circuit. Each sub-scan lines 2400 serves as a conductor that commonly connects the second gate electrodes 2562 of all second active devices 2520 disposed in a row along one scan line 2200 to the respective third active device 2600 which, in turn, is common to all the second active devices 2520 in that row.

When the active device array substrate 2000 is applied to the LCD panel, different data voltages can be input to the first pixel region and the second pixel region in each of the pixel units 2500 as will be described hereinafter. Thereby, the issue of different optical paths between the transmissive region 2500*a* and the reflective region 2500*b* of the transflective LCD panel can be obviated, and the same gray level can be displayed in both the transmissive region 2500*a* and in the reflective region 2500*b*. As such, the transflective LCD panel 2000 merely requires a single cell gap, and thus the fabrication of the transflective LCD panel 2000 is relatively simple, and the manufacturing costs of the LCD is reduced.

A method of fabricating a transflective LCD panel by applying the disclosed active device array substrate to the LCD panel is described hereinafter.

Figure 4A:
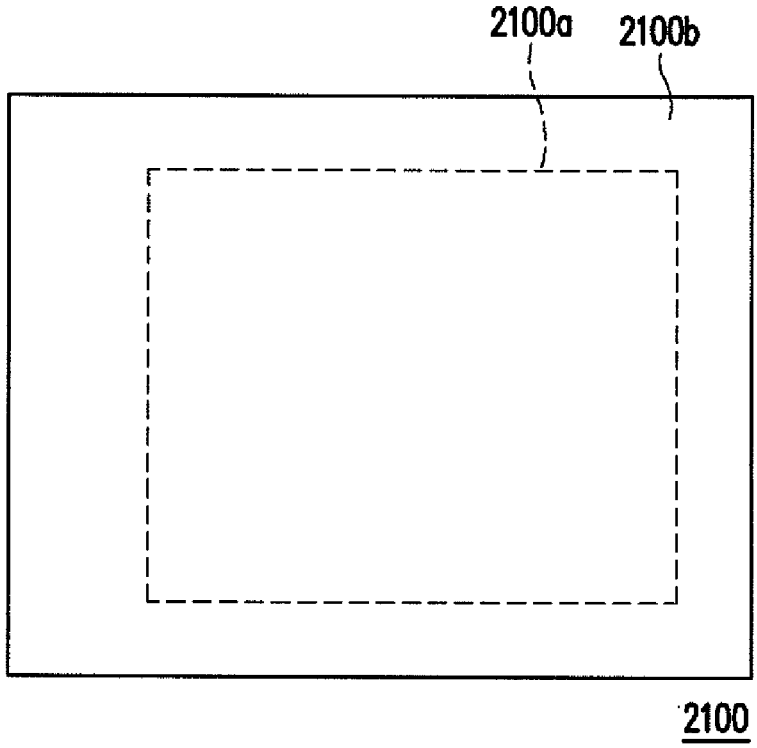
FIGS. 4A through 4D are schematic views illustrating a method of fabricating a transflective LCD panel according to an embodiment.
Figure 4B:
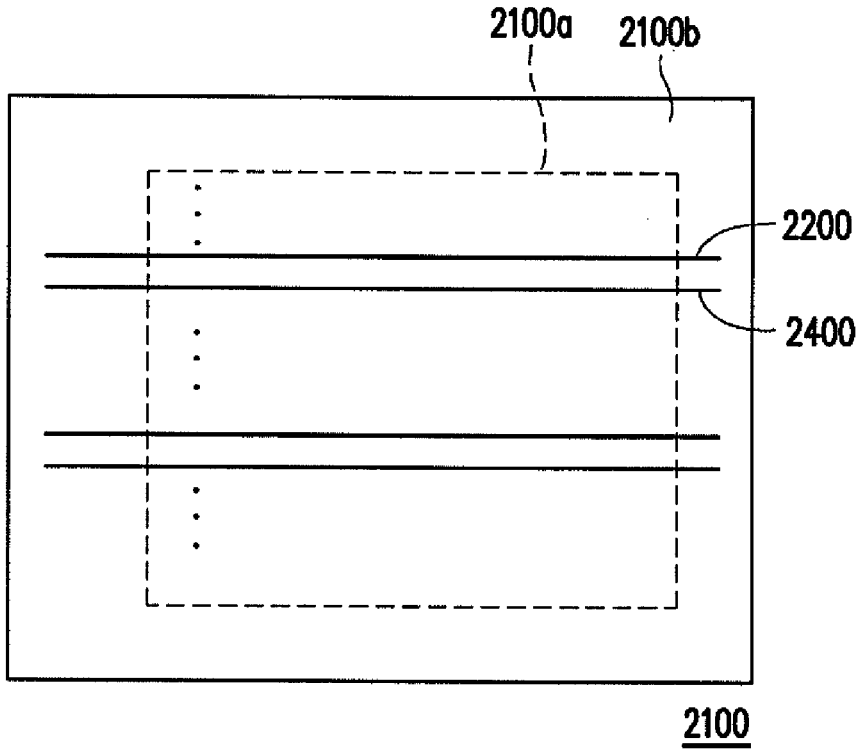
Figure 4C:
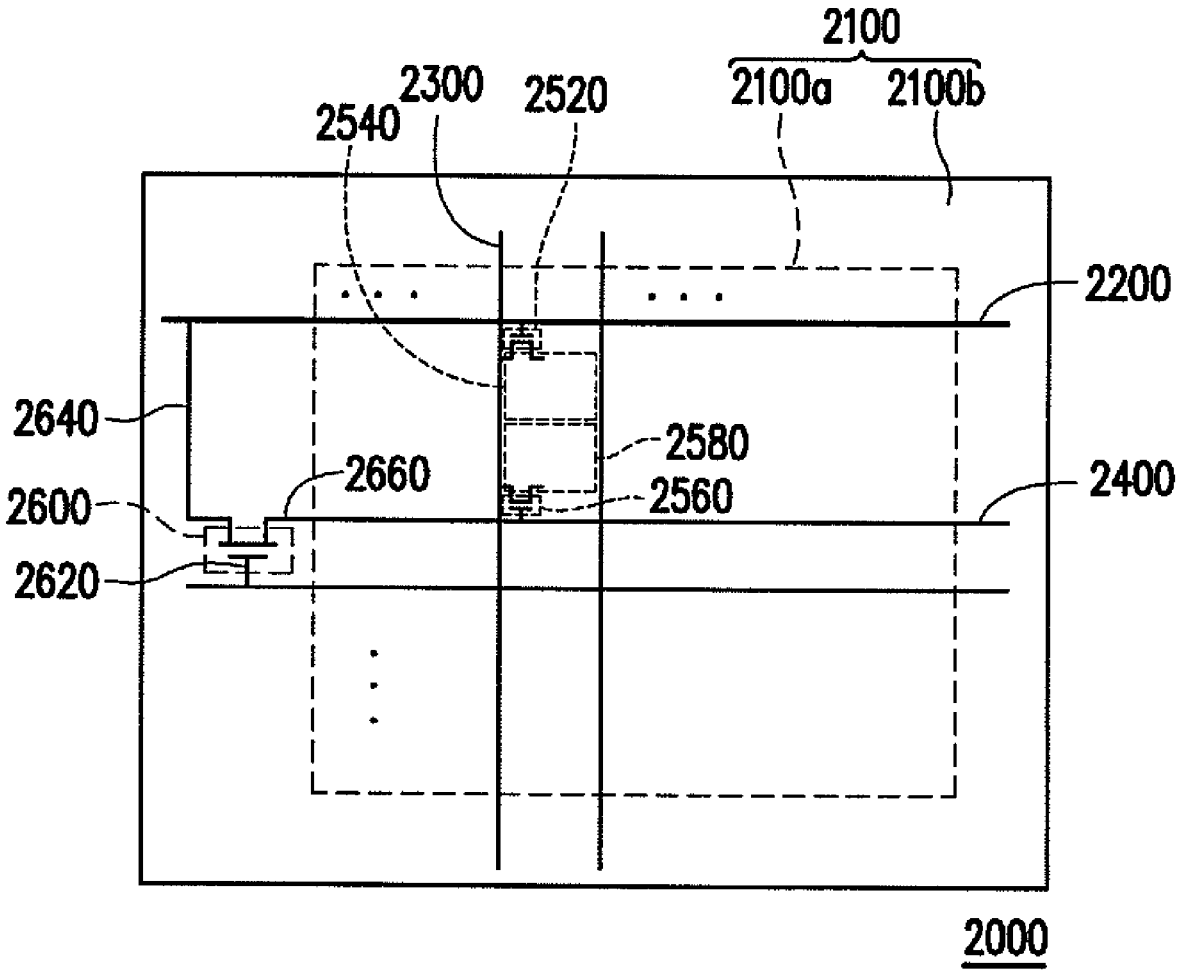
Figure 4D:
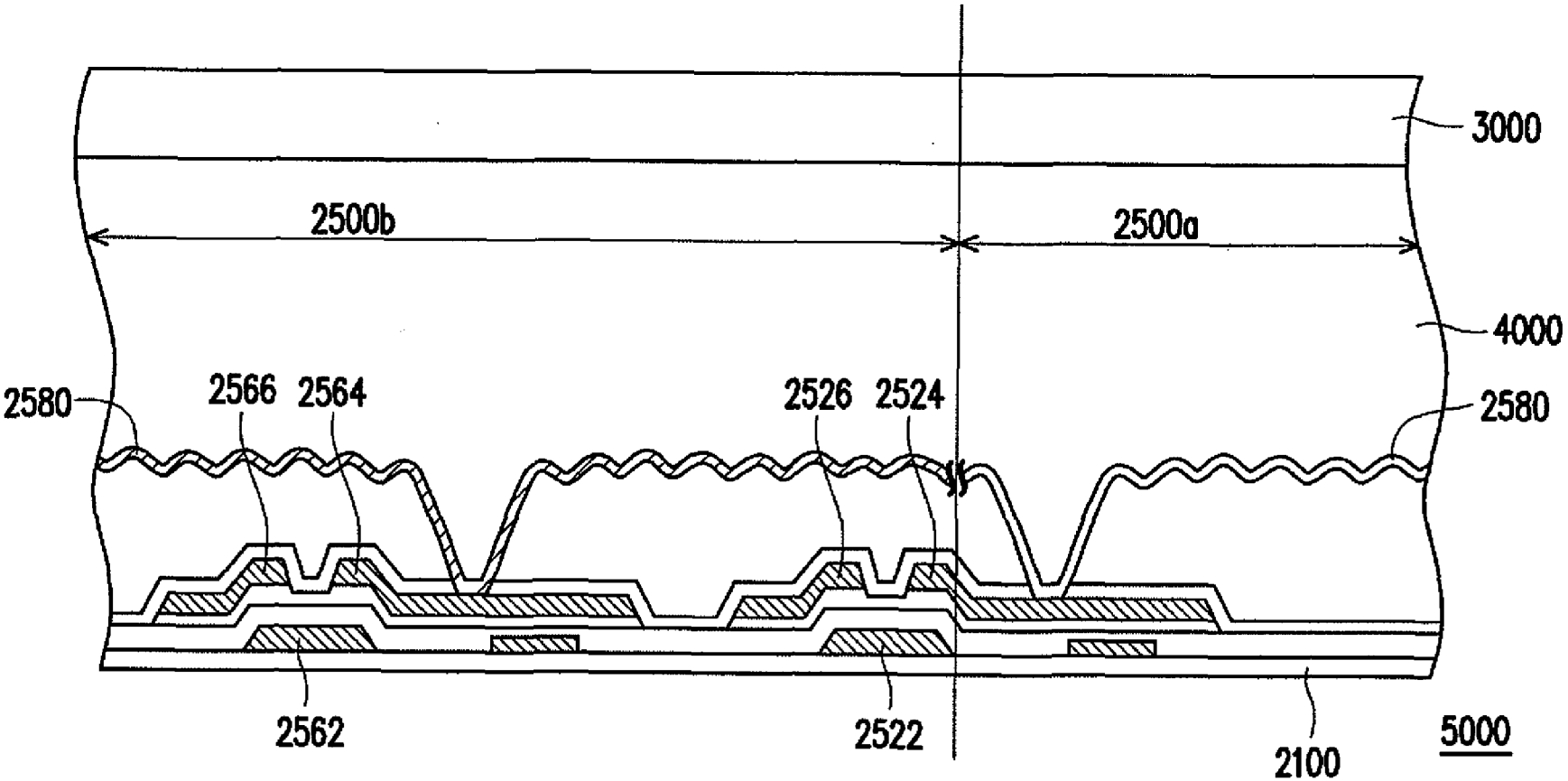

FIGS. 4A through 4D are schematic views illustrating a method of fabricating a transflective LCD panel according to an embodiment. FIGS. 4A through 4C are top views and FIG. 4D is a cross-sectional view. First, as shown in FIG. 4A, a substrate 2100 is provided, and a display region 2100*a* and a non-display region 2100*b* surrounding the display region 2100*a* are defined on the substrate 2100. Next, as shown in FIG. 4B, a plurality of first wires is formed on the substrate 2100. The first wires include scan lines 2200 and sub-scan lines 2400 arranged horizontally, a first gate electrode (shown in FIG. 3A), a second gate electrode 2562 (shown in FIG. 3A) which are all positioned in the display region 2100*a*, and a third gate electrode 2620 (shown in FIG. 4C) disposed in the non-display region 2100*b*.

Thereafter, as indicated in FIG. 4C, a plurality of second wires is formed on the substrate 2100. The second wires include data lines 2300, a first drain electrode 2524 (shown in FIG. 3A), a first source electrode 2526 (shown in FIG. 3A), a second drain 2564 electrode (shown in FIG. 3A), a second source electrode 2566 (shown in FIG. 3A) which are all positioned in the display region 2100*a*, and a third drain electrode 2640 and a third source electrode 2660 both disposed in the non-display region 2100*b*. Here, the data lines 2300 and the scan lines 2200 are arranged perpendicular to form a plurality of pixel units 2500. The first gate electrode 2522, the first drain electrode 2524 and the first source electrode 2526 together form a first active device 2520. The second gate electrode 2562, the second drain electrode 2564 and the second source electrode 2566 together construct a second active device 2560. The third gate electrode 2620, the third drain electrode 2640 and the third source electrode 2660 together forms a third active device 2600.

As indicated in FIG. 3A, a first pixel electrode 2540 and a second pixel electrode 2580 are formed on each of the pixel units 2500. The first pixel electrodes 2540 and the second pixel electrodes 2580 are electrically connected to the first active device 2520 and the second active device 2560, respectively, such that one pixel unit 2500 can be divided into a first pixel region and a second pixel region, and that the active device array substrate 2000 is further formed. In the present embodiment, the first pixel electrodes 2540 connected to the first drain electrode 2524 is made of transparent ITO, and the second pixel electrodes 2580 connected to the second drain electrode 2564 is made of metal or high-molecular material for reflecting light.

After that, as illustrated in FIG. 4D, an opposite substrate 3000 is provided and disposed on the active device array substrate 2000. The active device array substrate 2000 and the opposite substrate 3000 are then attached to form a transflective LCD panel 5000 of the present embodiment. According to the present embodiment, the opposite substrate 3000 may be a color filter substrate.

Alternatively, the opposite substrate 300 may be a transparent substrate. In such case, a color filter film layer can be further formed on the active device array substrate 200 before the opposite substrate 3000 is disposed on the active device array substrate 2000.

Note that before or after the active device array substrate 2000 and the opposite substrate 3000 are attached, liquid crystal molecules have to be injected between the active device array substrate 2000 and the opposite substrate 3000. For example, the liquid crystal molecules can be injected between the substrates by performing a one drop fill (ODF) process, such that the liquid crystal molecules form a liquid crystal layer 4000 when the active device array substrate 2000 and the opposite substrate 3000 are attached.

Figure 5:
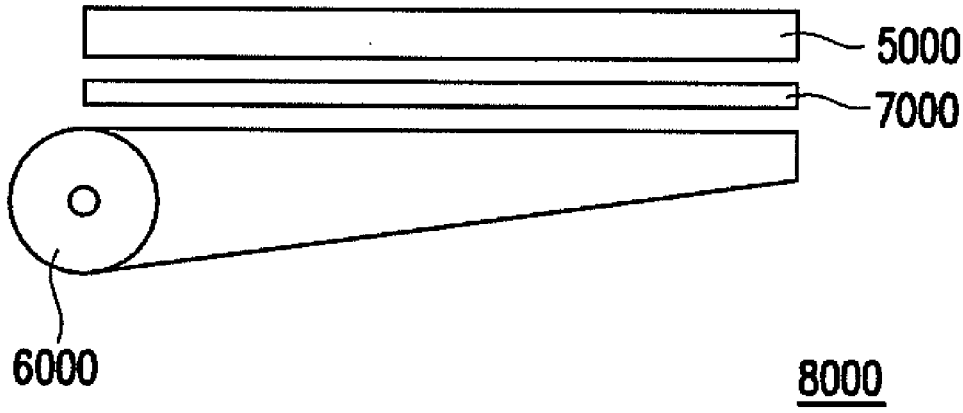
FIG. 5 is a schematic view of an LCD using the disclosed transflective LCD panel.

FIG. 5 is a schematic view of an LCD using the disclosed transflective LCD panel. With reference to FIG. 5, the transflective LCD panel 5000 is assembled to a backlight module 6000, so as to form an LCD 8000. The backlight module 6000 is, for example, a side-type backlight module, although the backlight module 6000 may be a direct type backlight module in another embodiment which is not depicted in the drawings.

Furthermore, to enhance the display performance of the LCD 8000, an optical film 7000 may be further disposed between the backlight module 6000 and the transflective LCD panel 5000. The optical film 7000 may be a prism film, a diffusion film or a brightness-enhanced film. The prism film can be used to adjust a direction in which the light is emitting from the backlight module 6000. The diffusion film allows the light emitted from the backlight module 6000 to form a planar light source of uniform brightness. The brightness-enhanced film can further increase luminance of the light emitted from the backlight module 6000.

The operation of the LCD panel of the disclosed embodiment, in accordance with a pixel level multiplexing (PLM) driving method, is described hereinafter.

Figure 6:
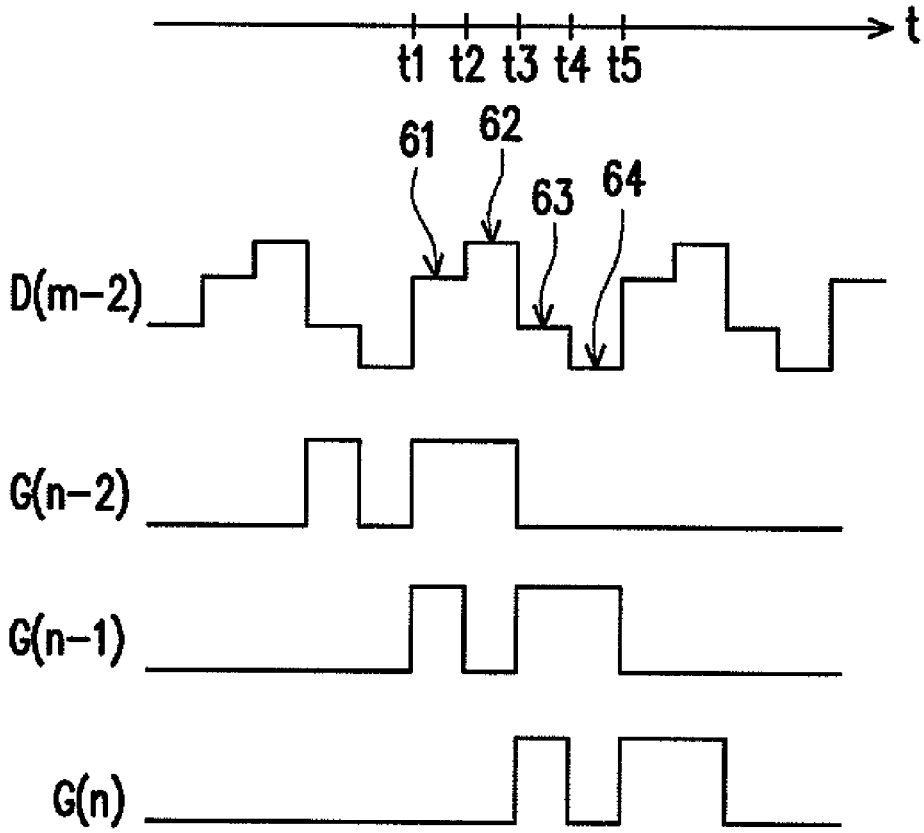
FIG. 6 is a signal timing diagram illustrating a driver voltage waveform of the LCD according to an embodiment.
Figure 7:
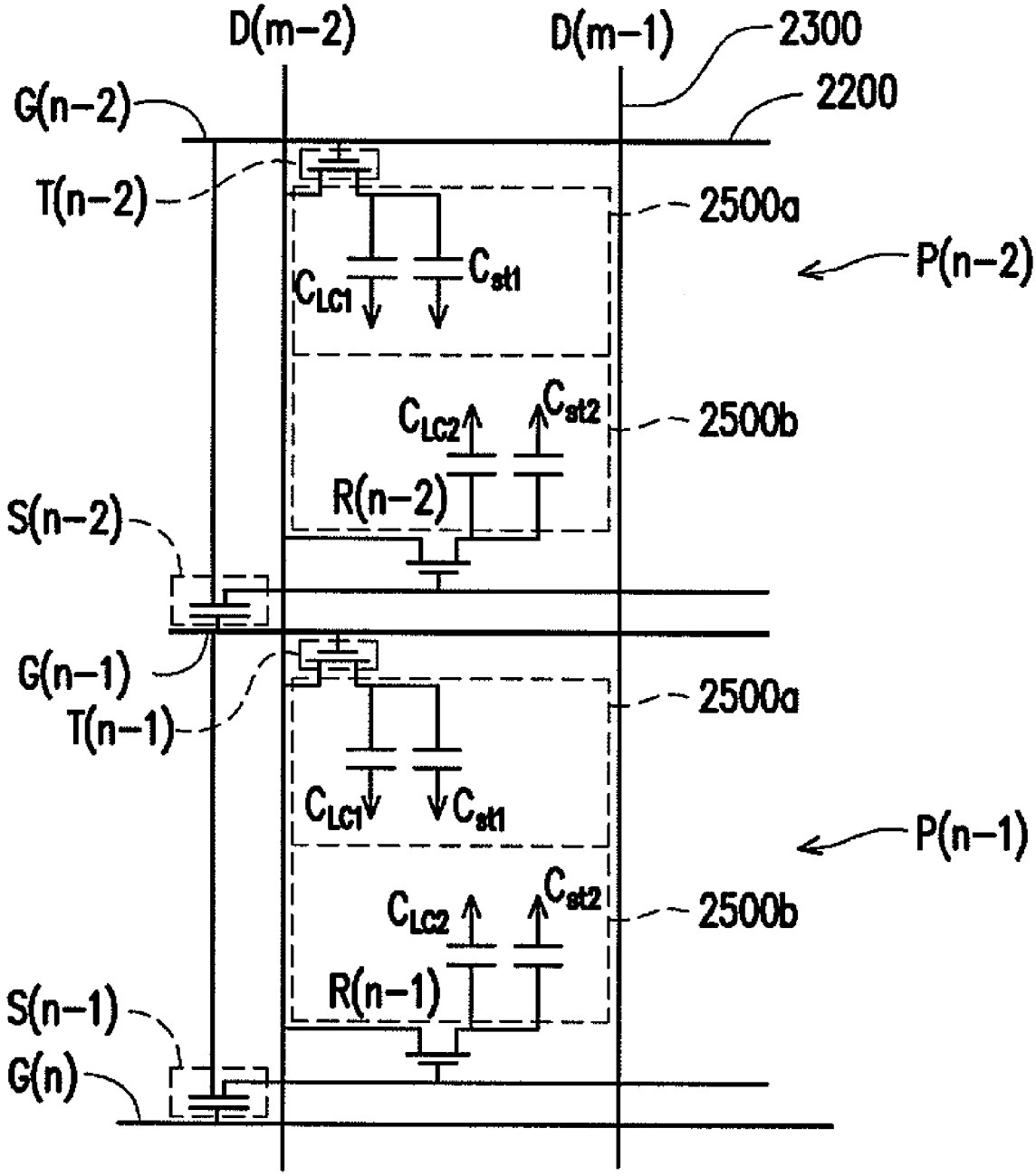
FIG. 7 is a schematic view illustrating a circuit from the $(n-2)^{th}$ scan line to the $n^{th}$ scan line and from the $(m-2)^{th}$ data line to the $(m-1)^{th}$ data line.

FIG. 6 is a signal timing diagram illustrating driver voltage waveforms generated by the driving circuits (not shown) of the LCD according to the present embodiment, and FIG. 7 is a schematic view illustrating a circuit from the $(n-2)^{th}$ scan line to the $n^{th}$ scan line and from the $(m-2)^{th}$ data line to the $(m-1)^{th}$ data line. The waveforms G(n−2) and G(n−1) in the signal timing diagram FIG. 6 indicate the signal waveforms corresponding to the $(n-2)^{th}$ scan line and the $(n-1)^{th}$ scan line as shown in FIG. 7, respectively. For the sake of clarity, in FIG. 7, the $(n-1)^{th}$ scan line is marked as G(n−1), the $(m-2)^{th}$ data line 2300 is marked as D(m−2), the $(n-1)^{th}$ first active device 2520 is marked as T(n−1), the $(n-1)^{th}$ second active device 2560 is marked as R(n−1), the $(n-1)^{th}$ third active device 2600 between the $(n-1)^{th}$ scan line 2200 and the $n^{th}$ scan line 2200 is marked as S(n−1), and so on.

In addition, G(n−2), G(n−1) and D(m−2) together drive the pixel P(n−2), and G(n−1), G(n) and D(m−2) together drive the pixel P(n−1).

Refer to FIGS. 6 and 7, as t is between t1~t2, G(n−1) and G(n−2) are high-level gate electrode driving voltage signals, and thus S(n−2) is turned on, and T(n−2), T(n−1) and R(n−2) are all in a turn-on state. Therefore, a D(m−2) data signal (level 61 in FIG. 6) can be written into a transmissive region 2500*a* and a reflective region 2500*b* of a pixel P(n−2), and the transmissive region 2500*a* of a pixel P(n−1) through T(n−2), R(n−2) and T(n−1), respectively. It should be noted that during the time period t1~t2, the transmissive regions 2500*a* of the pixels P(n−2) and P(n−1) are written with incomplete and/or incorrect signals. The transmissive regions 2500*a* of the pixels P(n−1) and P(n−1) therefore temporarily display incorrect images. The data writing to the reflective region 2500*b* of the pixel P(n−2) is, however, completed and the reflective region 2500*b* of the pixel P(n−2) displays the correct image.

Thereafter, when t is between t2~t3, G(n−1) is a low-level gate electrode driving voltage signal, and T(n−2) is still turned on. At this time, T(n−1) and R(n−2) are in a turn-off state. Here, the D(m−2) data signal (level 62 in FIG. 6) can be written into the transmissive region 2500*a* of the pixel P(n−2) through T(n−2), so as to update the incorrect signal previously written in the transmissive region 2500*a* of the pixel P(n−2) with the correct signal. The data writing to the pixel P(n−2) is finished and the correct images are displayed by both the transmissive region 2500*a* and the reflective region 2500*b* of the pixel P(n−2) at this time.

After that, when t is between t3~t4, G(n−2) is the low-level gate electrode driving voltage signal, and T(n−2) and R(n−2) are turned off. As such, the pixel P(n−2) does not update the image data. However, since G(n−1) and G(n) are both the high-level gate electrode driving voltage signals, T(n−1), S(n−1), R(n−1) and T(n) are all turned on. Thereby, the D(m−2) data signal (level 63 in FIG. 6) can be written into the transmissive region 2500*a* and reflective region 2500*b* of the pixel P(n−1), and the transmissive region 2500*a* of the pixel P(n) through T(n−1), R(n−1) and T(n), respectively. Thus, incorrect signals are temporarily written into the transmissive regions 2500*a* of the pixels P(n−1) and P(n) at this time. When t is between t4~t5, G(n) is the low-level gate electrode driving voltage signal, and T(n−1) is still turned on, but T(n) and R(n−1) are in the turn-off state. Meanwhile, the D(m−2) data signal (level 64 in FIG. 6) can be written into the transmissive region of the pixel P(n−1) through T(n−1), so as to update the incorrect signal previously written in the transmissive region of the pixel P(n−1) with the correct signal. The correct images are displayed by both the transmissive region 2500*a* and the reflective region 2500*b* of the pixel P(n−1) at this time.

The above-mentioned steps of data writing are repeated until the signal of the $N^{th}$ scan line 220 is completely written. The displaying and/or data writing states as well as the data voltages of the transmissive and reflective regions of the pixels P(n−1) and P(n−2) are summarized in the following table.

| | | t1~t2 | | t2~t3 | | t3~t4 | | t4~t5 | |
|---|---|---|---|---|---|---|---|---|---|
| | | data voltage | state | data voltage | state | data voltage | state | data voltage | state |
| P(n − 2) | transmissive 2500a | level 61 | writing | level 62 | writing | | | | |
| | reflective 2500b | level 61 | writing | | | | | | |
| P(n − 1) | transmissive 2500a | level 61 | writing | | | level 63 | writing | level 64 | writing |
| | reflective 2500b | | | | | level 63 | writing | | |

By using the timing signal and an arrangement of the third active devices 2600 as indicated respectively in FIG. 6 and FIG. 7, the transflective LCD panel 5000 of the present embodiment is able to input different data voltages to the transmissive region 2500*a* and the reflective region 2500*b* in each of the pixel units 2500. Thereby, the issue of different optical paths between the transmissive region and the reflective region of the transflective LCD panel can be overcome, whereas the same gray level can be displayed in both the transmissive region and in the reflective region. Accordingly, only the single cell gap structure is required by the transflective LCD panel of embodiments of the present invention. In comparison with the conventional transflective LCD panel, the transflective LCD panel 5000 can be fabricated in a simple and easy manner, and the manufacturing costs of an LCD 8000 can be further reduced.

Although the above embodiments are exemplified by the transflective LCD panel, people ordinarily skilled in the art may also apply the layout and the driving method to a transmissive LCD panel or a reflective LCD panel provided that they fall within the scope of the present invention. Affirmatively, the issue of color shift arisen from a large angle of the LCD panel can also be resolved through embodiments of the present invention.

To sum up, the active device array substrate in accordance with embodiments of the present invention, the transflective LCD panel using the active device array substrate, and the LCD using the same have at least the following advantages:

1. The layout of the active device array substrate is designed based on the LCD panel having the single cell gap, and thus the fabrication of the active device array substrate is comparatively easy and simple. Thereby, the manufacturing costs of the LCD panel and the LCD can be further reduced.
2. The third active devices are disposed in the non-display region of the active device array substrate to protect the original aperture from being adversely affected and achieve the better performance of LCD panel and LCD.

3. With a pixel level multiplexing (PLM) driving method, the active device array substrate can be applied to the transmissive LCD panel, the reflective LCD panel, and the transflective LCD panel with fewer limitations.

4. It has been observed that the PLM method for driving the LCD panel of the disclosed embodiment resolves the issue of color shift arises when the LCD panel is viewed at a large viewing angle.

It will be apparent to those skilled in the art that various modifications and variations can be made to the structure of the present invention without departing from the scope or spirit of the invention. In view of the foregoing, it is intended that the present invention cover modifications and variations that fall within the scope of the following claims and their equivalents.

What is claimed is:

1. A pixel unit for a liquid crystal display (LCD) panel that has a display region and a non-display region, said pixel unit comprising:

first and second pixels disposed in the display region;

an active element disposed in the non-display region and coupled to the second pixel;

a pair of scan lines, including a first scan line coupled to the first pixel and a second scan line coupled to the active element;

a data line; and controlling circuitry configured for placing (i) a first scan signal on the first scan line to drive the first pixel to a first pixel voltage from the data line during a first scan period, (ii) a third scan signal on the first scan line to drive the first pixel to a second pixel voltage from the data line during a second scan period, and (iii) a second scan signal on the second scan line to, collectively with the first scan signal on the first scan line, drive the second pixel to the first pixel voltage from the data line via the active element during the first scan period, wherein during the first scan period, the second scan signal is transmitted via the second scan line to enable the active element.

2. The pixel unit as claimed in claim 1, wherein the first pixel includes a transmissive region, and the second pixel includes a reflective region.

3. The pixel unit as claimed in claim 1, wherein the first pixel includes a first active device and a first pixel electrode, the second pixel includes a second active device and a second pixel electrode, wherein a portion of the second pixel electrode is disposed on a part of the first active device.

4. The pixel unit as claimed in claim 1, wherein during the first scan period, the first scan signal is transmitted to the first pixel via the first scan line, and the first scan signal is transmitted to the second pixel via the active element and the second scan line.

5. The pixel unit as claimed in claim 1, wherein during the second scan period, the third scan signal is transmitted to the first pixel via the first scan line, and a fourth scan signal is transmitted by the controlling circuitry via the second scan line to disable the active element.

6. The pixel unit as claimed in claim 1, wherein the third scan signal is continuous with and has the same amplitude as the first scan signal.

7. A liquid crystal display (LCD) panel having a display region and a non-display region surrounding the display region, said panel comprising:

N scan lines and M data lines disposed in the display region and extending into the non-display region, wherein the scan lines and the data lines are arranged to cross each other to define a plurality of pixel units, and N and M are non-zero positive integers;

N sub-scan lines disposed on a substrate, wherein the scan lines and the sub-scan lines are arranged alternately;

each of said pixel units being disposed in the display region and comprising:

a first active device having a first gate electrode, a first drain electrode and a first source electrode, wherein the first gate electrode is connected to the $n^{th}$ scan line, and the first source electrode is connected to the $m^{th}$ data line, n being a positive integer from 1 to N, m being a positive integer from 1 to M;

a first pixel electrode electrically connected to the first drain electrode;

a second active device having a second gate electrode, a second drain electrode and a second source electrode, wherein the second gate electrode is connected to the $n^{th}$ sub-scan line, and the second source electrode is connected to the $m^{th}$ data line; and a second pixel electrode electrically connected to the second drain electrode; and a plurality of third active devices disposed in the non-display region, each of the third active devices being disposed between the $n^{th}$ scan line and the $(n+1)^{th}$ scan line and having a third gate electrode, a third drain electrode and a third source electrode, wherein the third source electrode is connected to the $n^{th}$ sub-scan line, the third drain electrode is connected to the $n^{th}$ scan line, and the third gate electrode is connected to the $(n+1)^{th}$ scan line.

8. The liquid crystal display panel as claimed in claim 7, wherein the first pixel electrode includes a transmissive region, and the second pixel electrode includes a reflective region.

9. The liquid crystal display panel as claimed in claim 7, further comprising a color filter layer disposed on and covering the scan lines, the data lines and the pixel units.

10. The liquid crystal display panel as claimed in claim 7, wherein a part of the second pixel electrode is disposed on a part of the first active device.

11. The liquid crystal display panel as claimed in claim 7, further comprising controlling circuitry configured for transmitting, during a first scan period, a first scan signal to the first active device via the $n^{th}$ scan line to enable the first active device, a second scan signal to the third active device via the $(n+1)^{th}$ scan line to enable the third active device, whereby the first scan signal is transmitted to the second active device via the enabled third active device and the $n^{th}$ sub-scan line to enable the second active device.

12. The liquid crystal display panel as claimed in claim 11, wherein said controlling circuitry is further configured for transmitting, during a second scan period, a third scan signal to the first active device via the $n^{th}$ scan line to enable the first active device, and a fourth scan signal to the third active device via the $(n+1)^{th}$ scan line to disable the third active device and the second active device.

13. The liquid crystal display panel as claimed in claim 7, further comprising controlling circuitry configured for transmitting via the $m^{th}$ data line during the first scan period, a first data signal to the first pixel electrode via the first active device and to the second pixel electrode via the second active device; and during the second scan period, a second data signal to the first pixel electrode via the first active device.

14. The liquid crystal display panel as claimed in claim 12, wherein the third scan signal on the $n^{th}$ scan line is continuous with and has the same amplitude as the first scan signal on the $n^{th}$ scan line.

15. A method of driving a liquid crystal display panel having a display region and a non-display region surrounding the display region, said panel comprising:

a plurality of pixels disposed on the display region;

a plurality of transistors disposed on the non-display region;

a plurality of scan lines and data lines intersecting one another to define the pixels, wherein each said pixel is defined by a pair of adjacent said scan lines and one of said data lines and includes a first sub-pixel controlled by a first scan line of the pair of scan lines; and a second sub-pixel controlled by a second scan line of the pair of scan lines, said second scan line being coupled to one of the transistors, said method comprising:

activating the first scan line, the second scan line and the respective transistor during a first scan period to write a first voltage from the respective data line to the first and second sub-pixels; and maintaining the first scan line activated and deactivating the second scan line and the respective transistor during a second, subsequent scan period to write a second, different voltage from the respective data line to the first sub-pixel and to maintain the second sub-pixel at the first voltage, wherein during the first scan period, a second scan signal is transmitted to the second sub-pixel via the second scan line to enable the respective transistor.

16. The method as claimed in claim 15, wherein the first sub-pixel includes a transmissive region, and the second sub-pixel includes a reflective region of the respective pixel.

17. The method as claimed in claim 15, wherein the first sub-pixel includes a first active device and a first pixel electrode, the second sub-pixel includes a second active device and a second pixel electrode, wherein a portion of the second pixel electrode is disposed on a part of the first active device.

18. The method as claimed in claim 17, wherein during the first scan period, a first scan signal is transmitted to the first sub-pixel via the first scan line, and the first scan signal is transmitted to the second sub-pixel via the enabled transistor and the second scan line to enable the second active device.

19. The method as claimed in claim 15, wherein during the second scan period, a third scan signal is transmitted to the first sub-pixel via the first scan line, and a fourth scan signal is transmitted to the second sub-pixel via the second scan line to disable the transistor.

20. The method as claimed in claim 19, wherein the third scan signal on the first scan line is continuous with and has the same amplitude as the first scan signal on the first scan line.

* * * * *